US008738341B2

(12) United States Patent
Habashy et al.

(10) Patent No.: US 8,738,341 B2
(45) Date of Patent: May 27, 2014

(54) METHOD FOR RESERVOIR CHARACTERIZATION AND MONITORING INCLUDING DEEP READING QUAD COMBO MEASUREMENTS

(75) Inventors: Tarek Habashy, Burlington, MA (US); R. K. Michael Thambynayagam, Sugar Land, TX (US); Aria Abubakar, North Reading, MA (US); Jeff Spath, Missouri City, TX (US); Raj Banerjee, Abingdon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1007 days.

(21) Appl. No.: 12/004,792

(22) Filed: Dec. 21, 2007

(65) Prior Publication Data

US 2009/0164187 A1 Jun. 25, 2009

(51) Int. Cl.

| | |
|---|---|
| ***G06G 7/50*** | (2006.01) |
| ***G06G 7/57*** | (2006.01) |
| ***G06G 7/48*** | (2006.01) |

(52) U.S. Cl.
USPC ..... 703/10; 703/9

(58) Field of Classification Search
USPC ..... 703/10
See application file for complete search history.

(56) References Cited

U.S. PATENT DOCUMENTS

| | | | | |
|---|---|---|---|---|
| 5,672,819 | A | 9/1997 | Chin et al. | |
| 5,764,515 | A | 6/1998 | Guerillot et al. | |
| 6,061,634 | A | 5/2000 | Belani et al. | |
| 6,166,994 | A | 12/2000 | Jeffryes | |
| 6,182,012 | B1 | 1/2001 | Laurent et al. | |
| 6,236,943 | B1 * | 5/2001 | Aminzadeh et al. | 702/16 |
| 6,388,947 | B1 * | 5/2002 | Washbourne et al. | 367/73 |
| 6,393,363 | B1 | 5/2002 | Wilt et al. | |
| 6,427,124 | B1 * | 7/2002 | Dubinsky et al. | 702/9 |
| 6,662,109 | B2 | 12/2003 | Roggero et al. | |
| 6,670,813 | B2 | 12/2003 | Strack | |
| 6,712,140 | B2 | 3/2004 | Van Oers et al. | |
| 6,778,918 | B2 | 8/2004 | Delhomme et al. | |
| 6,899,178 | B2 | 5/2005 | Tubel | |

(Continued)

FOREIGN PATENT DOCUMENTS

| | | |
|---|---|---|
| AR | 069915 A1 | 3/2010 |
| GB | 2468045 A | 8/2010 |

(Continued)

OTHER PUBLICATIONS

Alpak et al. "Joint Inversion of Transient-PRessure and Time-Lapse Electromagnetic Logging Measurements", May-Jun. 2004, Petrophysics, vol. 45, No. 3, pp. 251-267.*

(Continued)

*Primary Examiner* — Suzanne Lo

(57) ABSTRACT

A method is disclosed for building a predictive or forward model adapted for predicting the future evolution of a reservoir, comprising: integrating together a plurality of measurements thereby generating an integrated set of deep reading measurements, the integrated set of deep reading measurements being sufficiently deep to be able to probe the reservoir and being self-sufficient in order to enable the building of a reservoir model and its associated parameters; generating a reservoir model and associated parameters in response to the set of deep reading measurements; and receiving, by a reservoir simulator, the reservoir model and, responsive thereto, generating, by the reservoir simulator, the predictive or forward model.

20 Claims, 9 Drawing Sheets

(56) References Cited

U.S. PATENT DOCUMENTS

| | | | | |
|---|---|---|---|---|
| 6,922,373 | B2 | 7/2005 | Armstrong | |
| 6,980,940 | B1 | 12/2005 | Gurpinar et al. | |
| 7,030,617 | B2 | 4/2006 | Conti | |
| 7,069,148 | B2 | 6/2006 | Thambynayagam et al. | |
| 7,187,620 | B2 | 3/2007 | Nutt et al. | |
| 7,191,071 | B2 | 3/2007 | Kfoury et al. | |
| RE39,844 | E * | 9/2007 | Srnka | 324/354 |
| 7,340,348 | B2 * | 3/2008 | Strack et al. | 702/14 |
| RE40,321 | E * | 5/2008 | Srnka | 324/354 |
| 7,502,690 | B2 * | 3/2009 | Thomsen et al. | 702/2 |
| 7,805,250 | B2 * | 9/2010 | Colombo et al. | 702/14 |
| 2005/0116709 | A1 | 6/2005 | Proett et al. | |
| 2007/0294036 | A1 | 12/2007 | Strack et al. | |
| 2008/0162050 | A1 | 7/2008 | Harris et al. | |
| 2009/0164187 | A1 | 6/2009 | Habashy et al. | |
| 2009/0164188 | A1 | 6/2009 | Habashy et al. | |
| 2010/0027376 | A1 | 2/2010 | Washbourne et al. | |

FOREIGN PATENT DOCUMENTS

| | | | |
|---|---|---|---|
| GB | 2474150 | A | 4/2011 |
| WO | 2009082605 | A1 | 7/2009 |
| WO | 2009140056 | A1 | 11/2009 |

OTHER PUBLICATIONS

Chen, J., et al., "A Bayesian model for gas saturation estimation using marine seismic AVA and CSEM data", Geophysics, Mar.-Apr. 2007, pp. WA85-WA95, vol. 72, No. 2.

Harris, P. and MacGregor, L., "Determination of reservoir properties from the integration of CSEM, seismic, and well-log data", First Break, Nov. 2006, pp. 15-21, vol. 24.

Haber, E., and D. Oldenburg, "Joint inversion: A structural approach", Inverse Problems, 1997, pp. 63-77, vol. 13, No. 1, UK.

Musil, M., H.R. Maurer, and Green, A., "Discrete tomography and joint inversion for loosely connected or unconnected physical properties: application to crosshole seismic and georadar data sets", Geophysical Journal International, 2003, pp. 389-402,No. 2.

Gallardo, L. A., and M. A. Meju, "Characterization of heterogeneous near-surface materials by joint 2D inversion of dc resistivity and seismic data", Geophysical Research Letters, 2003, pp. 1-4, vol. 30, No. 13.

Gallardo, L. A., and M. A. Meju, "Joint two-dimensional DC resistivity and seismic travel time inversion with cross gradient constraints", Journal of Geophysical Research, 2004, pp. 1-11, vol. 109.

Gallardo, L. A., and M. A. Meju, "Joint two-dimensional cross-gradient imaging of magnetotelluric and seismic traveltime data for structural and lithological classification", Geophys. J. Int., 2007, pp. 1261-1272, vol. 169 Issue 3.

Colombo, D and Destefano, M, "Geophysical modeling via simultaneous joint inversion of seismic, gravity, and electromagnetic data: Application to prestack depth imaging", The Leading Edge, Mar. 2007, pp. 326-331.

Colombo, D et. al., "Simultaneous joint inversion of seismic and gravity data for long offset prestack depth migration in Northern Oman", CSPG CSEG Convention, 2007, pp. 191-195.

Hu, W, Abubakar, A. and Habashy, T, "Joint Inversion Algorithm for Electromagnetic and Seismic Data", Extended Abstract of the 2007 SEG Annual Meeting, Sep. 23-28, 2007,pp. 1745-1749, San Antonio, TX, USA.

Smith, T., Hoversten, M., Gasperikova, E., and Morrison, F., "Sharp boundary inversion of 2D magnetotelluric data," Geophysical Prospecting, 1999, pp. 469-486, vol. 47.

Hoversten, M., Rosten, T., Hokstad, K., Alumbaugh, D., Horne, S., and Newman, G., "Integration of multiple electromagnetic imaging and inversion techniques for prospect evaluation," 2006 SEG Annual Meeting, Oct. 1-6, 2006, pp. 1-4, New Orleans, Louisiana, USA.

Hoversten, G. M., Constable, S.C. and Morrison H. F., "Marine magnetotellurics for base-of-salt mapping: Gulf of Mexico field test at the Gemini structure", Geophysics, Sep.-Oct. 2000, pp. 1476-1488, vol. 65, No. 5.

Zhang, Y., Abubakar, A., Habashy, T., Druskin, V. and Knizhnerman, L., "Parametric inversion algorithm for marine controlled source electromagnetic data", Extended Abstract of 2007 SEG Annual Meeting, Sep. 23-28, 2007, pp. 569-573, San Antonio, TX, USA.

Hoversten, M.G., Gritto, R., Washbourne, J. and Daley, T., "Pressure and fluid saturation prediction in a multicomponent reservoir using combined seismic and electromagnetic imaging", Geophysics, Sep.-Oct. 2003, pp. 1580-1591, vol. 68, No. 5.

Alpak, O.F., Torres-Verdin, C. and Habashy, T., "Joint inversion of pressure and DC resistivity measurements acquired with in-situ permanent sensors: a numerical study," Geophysics, Sep.-Oct. 2004, pp. 1173-1191, vol. 69, No. 5.

Alpak, O.F., Torres-Verdin, C., Habashy, T. and Dussan, E.V., "Joint Inversion of Transient-Pressure and Time-Lapse Electromagnetic Logging Measurements," Petrophysics, May-Jun. 2004, pp. 251-267. vol. 45, No. 3.

Alpak, O.F., Torres-Verdin, C. and Habashy, T., "Petrophysical inversion of borehole array-induction logs: Part I—Numerical examples," Geophysics, Jul.-Aug. 2006, pp. F101-F119, vol. 71, No. 4.

Torres-Verdin, C., Alpak, O.F. and Habashy, T., "Petrophysical inversion of borehole array-induction logs: Part II—Field data examples," Geophysics, Jul.-Aug. 2006, pp. G261-G268, vol. 71, No. 4.

Hoversten, G. M., et al., "Direct reservoir parameter estimation using joint inversion of marine seismic AVA and CSEM data",Geophysics, May-Jun. 2006, pp. C1-C13, vol. 71, No. 3.

Zhangshuan H., et al., "Reservoir-parameter identification using minimum relative entropy-based Bayesian inversion of seismic AVA and marine CSEM data", Geophysics, Nov.-Dec. 2006, pp. O77-O88, vol. 71, No. 6.

"Topic Paper #19—Conventional Oil and Gas (Including Arctic and Enhanced Oil Recovery)", National Petroleum Council, Jul. 18, 2007, pp. 1-29.

Bachrach, et al., "Combining Rock Physics Analysis, Full Waveform Prestack Inversion and High-Resolution Seismic Interpretation to Map Lithology Units in Deep Water: A Gulf of Mexico Case Study", The Leading Edge, Apr. 2004, pp. 378-383.

Berge, et al., "Seismic inversion successfully predicts reservoir, porosity, and gas content in Ibhubesi Field, Orange Basin, South Africa", The Leading Edge, 2002, pp. 338, 340, 342, 344, 346, 348.

Christie, M.A., "Upscaling for reservoir simulation", Journal of Petroleum Technology, vol. 48 (11),1996, pp. 1004-1010.

Contreras, et al., "Joint stochastic inversion of 3D pre-stack seismic data and well logs for high-resolution reservoir characterization and petrophysical modeling: application to deepwater hydrocarbon reservoirs in the central Gulf of Mexico", SPWLA Society of Petrophysicists and Well Log Analysts 46th Annual Logging Symposium, 2005, 4 pages.

Jarvis, Kevin, "Integrating well and seismic data for reservoir characterization: risks and rewards", Association of Energy Service Companies (AESC), 2006, pp. 1-4.

Lindsay, et al., "Sequential Backus Averaging: Upscaling well logs to seismic wavelengths", The Leading Edge, 2001, pp. 188-191.

Liu, et al., "An Iterative Inversion of Seismic Data Constrained by Wells Using Artificial Neural Networks", Offshore Technology Conference, 1998, pp. 341-348.

Partyka, et al., "Upscaling petrophysical properties to the seismic scale", downloaded from the Wayback Machine, http://www.freeusp.org/RaceCarWebsite/TechTransfer/OnlineTraining/BackusUpscaling/BackusUpscaling_Index.html, Mar. 2005, 4 pages.

Pendrel, "Seismic Inversion—The Best Tool for Reservoir Characterization", CSEG Canadian Society of Exploration Geophysics Recorder, vol. 26, No. 1, 2001, 7 unnumbered pages.

Pendrel, John, "Seismic Inversion—A Critical Tool in reservoir Characterization", Scandinavian Oil-Gas Magazine, No. 5/6, 2006, pp. 19-22.

Reymond, et al., "Mapping reservoir saturation with seismic resolution to improve reservoir model", Society of Petroleum Engineers, SPE 57259, 1999, 4 pages.

Sengupta, et al., "Uncertainty in seismic-based pay vol. estimation: analysis using rock physics and Bayesian statistics", The Leading Edge, Feb. 2007, pp. 184-189.

Wu, et al., "Combined Seismic Inversion Methods in Reservoir Model Development", Paper SPE 109626, Society of Petroleum Engineers Annual Technical Conference and Exhibition, Nov. 11, 2007, pp. 1-8.

Young, "Model-Based Inversion of Multiple Offset Data for Elastic Parameter Estimation", Exploration Geophysics Symposium, 2006, 28 pages.

* cited by examiner

METHOD FOR RESERVOIR CHARACTERIZATION AND MONITORING INCLUDING DEEP READING QUAD COMBO MEASUREMENTS

BACKGROUND

The subject matter disclosed in this specification relates to a method for reservoir characterization and monitoring including defining a suite of deep reading measurements that are used for the purpose of building a reservoir model that is input to a reservoir simulator, the reservoir simulator building a predictive or forward model.

To date, most of the information for reservoir characterization is primarily derived from three main sources: well-logs/cores, surface seismic and well testing. Well logs and cores provide detailed high-resolution information but with a coverage that is limited to about a couple of meters around the well location in the reservoir. On the other hand, surface seismic provides large volume 3-D coverage but with a relatively low resolution (on the order of 20-50 feet resolution). In recent years, service companies have expanded their offerings to a wide range of measurements that have the potential to illuminate the reservoir with diversely varying coverage and resolution. Deep probing measurements, such as cross-well, long-offset single-well, surface and surface-to-borehole electromagnetic measurements, cross-well seismic, borehole seismic and VSP, gravimetry and production testing, are intended to close the gap between the high resolution shallow measurements from conventional logging tools and deep penetrating, low resolution techniques, such as surface seismic.

This specification discloses a suite of deep reading measurements that complement each other and, as a result, allows one to infer pertinent reservoir properties that would enable the prediction of a performance of a reservoir and allow for the making of appropriate field management decisions.

As a result, by integrating the suite of deep reading measurements, the predictive capacity of a forward reservoir model can be enhanced.

SUMMARY

One aspect of the present invention involves a method for building a predictive or forward model adapted for predicting the future evolution of a reservoir, comprising: integrating together a plurality of measurements thereby generating an integrated set of deep reading measurements, the integrated set of deep reading measurements being sufficiently deep to be able to probe the reservoir and being self-sufficient in order to enable the building of a reservoir model and its associated parameters; generating a reservoir model and associated parameters in response to the integrated set of deep reading measurements; and receiving, by a reservoir simulator, the reservoir model and, responsive thereto, generating, by the reservoir simulator, the predictive or forward model.

Another aspect of the present invention involves a system adapted for building a predictive or forward model adapted for predicting the future evolution of a reservoir, an integrated set of deep reading measurements being sufficiently deep to be able to probe the reservoir and being self-sufficient in order to enable the building of a reservoir model and its associated parameters, comprising: an apparatus adapted for receiving the integrated set of deep reading measurements and building a reservoir model in response to the receipt of the integrated set of deep reading measurements, the apparatus including a reservoir simulator, the reservoir simulator receiving the reservoir model and, responsive thereto, generating a predictive or forward model, the predictive or forward model being adapted for accurately predicting a future evolution of said reservoir in response to the integrated set of deep reading measurements.

Another aspect of the present invention involves a computer program stored in a processor readable medium and adapted to be executed by the processor, the computer program, when executed by the processor, conducting a process for building a predictive or forward model adapted for predicting the future evolution of a reservoir, an integrated set of deep reading measurements being sufficiently deep to be able to probe the reservoir and being self-sufficient in order to enable the building of a reservoir model and its associated parameters, the process comprising: receiving, by the computer program, the integrated set of deep reading measurements and, responsive thereto, building a reservoir model, the computer program including a reservoir simulator; receiving, by the reservoir simulator, the reservoir model; and generating, by the reservoir simulator, the predictive or forward model adapted for predicting the future evolution of the reservoir in response to the integrated set of deep reading measurements.

Another aspect of the present invention involves a program storage device readable by a machine tangibly embodying a set of instructions executable by the machine to perform method steps for building a predictive or forward model adapted for predicting the future evolution of a reservoir, an integrated set of deep reading measurements being sufficiently deep to be able to probe the reservoir and being self-sufficient in order to enable the building of a reservoir model and its associated parameters, the method steps comprising: receiving, by the machine, the integrated set of deep reading measurements and, responsive thereto, building a reservoir model, the set of instructions including a reservoir simulator; receiving, by the reservoir simulator, the reservoir model; and generating, by the reservoir simulator, the predictive or forward model adapted for predicting the future evolution of the reservoir in response to the integrated set of deep reading measurements.

Further scope of applicability will become apparent from the detailed description presented hereinafter. It should be understood, however, that the detailed description and the specific examples set forth below are given by way of illustration only, since various changes and modifications within the spirit and scope of the "method for reservoir characterization and monitoring including deep reading quad combo measurements", as described and claimed in this specification, will become obvious to one skilled in the art from a reading of the following detailed description.

BRIEF DESCRIPTION OF THE DRAWINGS

A full understanding will be obtained from the detailed description presented hereinbelow, and the accompanying drawings which are given by way of illustration only and are not intended to be limitative to any extent, and wherein.

DETAILED DESCRIPTION

This specification discloses a set of deep reading measurements that are sufficiently deep to be able to probe the reservoir and that are self-sufficient to provide a means by which a reservoir model and its associated parameters can be built. Such a model will be the input to a reservoir simulator, which, in principle, will provide a mechanism for building a predictive or forward model.

Reservoir simulators receive, as input, a set of 'input parameters', which, if known exactly, would allow the reservoir simulations to deterministically predict the future evolution of the reservoir (with an associated uncertainty error). However, it is generally assumed that the 'input parameters' are poorly known. As a result, the poorly known 'input parameters' represent the 'dominant uncertainty' in the modeling process. Hence, a judicial selection of measurements, adapted for providing or defining the 'input parameters', will have a real impact on the accuracy of these input parameters.

A 'suite of measurements' are disclosed in this specification which are hereinafter referred to as a "deep-reading quad-combo suite of measurements". The deep-reading quad-combo suite of measurements includes: seismic measurements, electromagnetic measurements, gravity measurements, and pressure measurements as well as all the possible combinations of these four measurements (i.e. two and three of these measurements at a time and also all four of these measurements) in a joint interpretation/inversion. Such a quad-combo suite of measurements represents the reservoir counterpart of the 'triple-combo' for well logging. This 'deep quad-combo' suite of measurements can have several manifestations, depending on the way they are deployed: from the surface, surface-to-borehole (or borehole-to-surface), cross-well, or even in a long-offset single-well deployment, or a combination of any or all of the above. Each of these four 'deep reading' measurements, on their own, will have problems in delivering useful or sufficiently comprehensive information about the reservoir because of the non-uniqueness and limited spatial resolution that are sometimes associated with their interpretation. However, when the above referenced four 'deep reading' measurements as well as all the possible combinations of these four measurements (i.e. two and three of these measurements at a time and also all four of these measurements) in a joint interpretation/inversion are "integrated" together, and perhaps, in addition, are integrated with other measurements [such as 'near-wellbore' Wireline (WL) and Logging While Drilling (LWD)], the above referenced 'deep reading quad-combo suite of measurements' will provide 'considerable value' and 'significant differentiation' to the set of 'input parameters' that are received by the reservoir simulators. As a result, a more accurate predictive or forward reservoir model will be generated.

Figure 1:
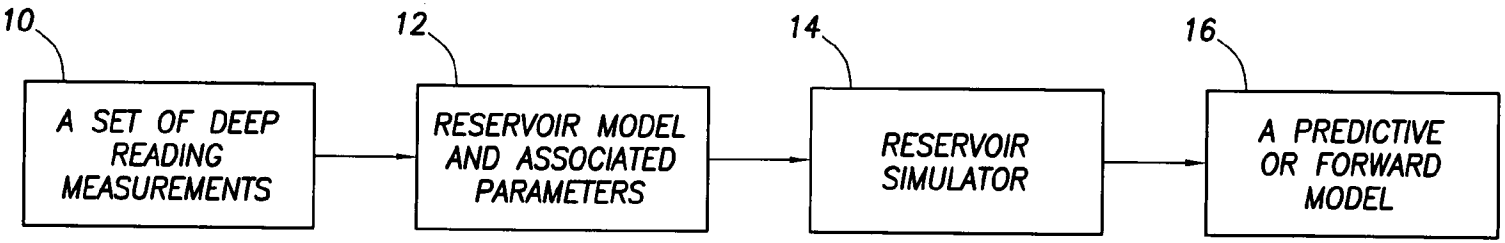
FIG. 1 illustrates a method responsive to a set of deep reading measurements for generating a predictive or forward reservoir model that can accurately predict the performance of a reservoir.

Referring to FIG. 1, a method is illustrated that is responsive to a set of deep reading measurements for the purpose of generating a predictive or forward reservoir model that can accurately predict the performance of a reservoir. In FIG. 1, a set of deep reading measurements 10 are provided, the deep reading measurements 10 being sufficiently deep in order to probe a reservoir and being self-sufficient in order to provide a means by which a reservoir model and its associated parameters 12 can be built. The reservoir model 12 is input to a reservoir simulator 14, which, in principle, will provide a mechanism for building a predictive or forward reservoir model 16.

Figure 2:
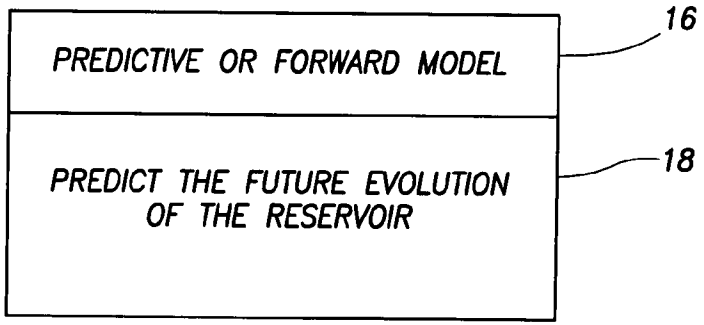
FIG. 2 illustrates the function of the predictive of forward model of FIG. 1 as including the accurate prediction of the future evolution of the reservoir.

Referring to FIG. 2, the predictive or forward model 16 will predict the future evolution of the reservoir 18.

Figure 3:
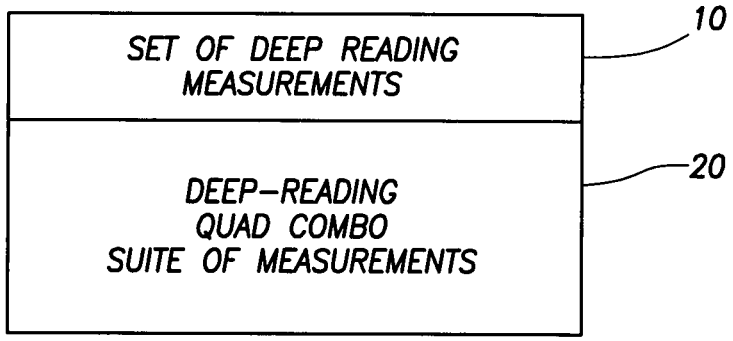
FIG. 3 illustrates the set of deep reading measurements of FIG. 1 as including a set of deep reading quad combo suite of measurements.

Referring to FIG. 3, the set of deep reading measurements 10 of FIG. 1 actually includes a 'deep-reading quad-combo suite of measurements' 20.

Figure 4:
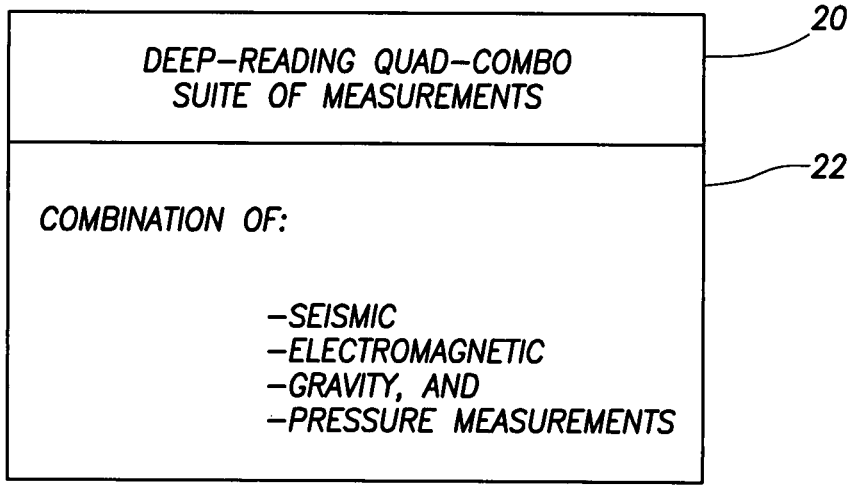
FIG. 4 illustrates the deep reading quad combo suite of measurements as including a combination of seismic, electromagnetic, gravity, and pressure measurements.

Referring to FIG. 4, an 'integrated combination' of seismic measurements, electromagnetic measurements, gravity measurements, and pressure measurements' 22 is illustrated. In FIG. 4, the 'deep-reading quad-combo suite of measurements' 20 of FIG. 3 includes an 'integrated' combination of: (1) seismic measurements, (2) electromagnetic measurements, (3) gravity measurements, and (4) pressure measurements, as indicated by numeral 22 of FIG. 4. That is, the 'deep-reading quad-combo suite of measurements' 20 include integrated combinations of the individual measurements (seismic, electromagnetic, gravity, and pressure) and all possible combinations of these four measurements (two and three of these measurements at a time and also all four of these measurements) in a joint interpretation/inversion. As noted earlier, these deep-reading quad-combo suite of measurements 20 (i.e., the 'integrated combination' of seismic, electromagnetic, gravity, and pressure measurements as well as all possible combinations thereof 22 of FIG. 4), when 'integrated together', and perhaps, in addition, when 'integrated together' with other measurements, such as near-wellbore WL and LWD, will provide considerable value and significant differentiation.

Figure 5:
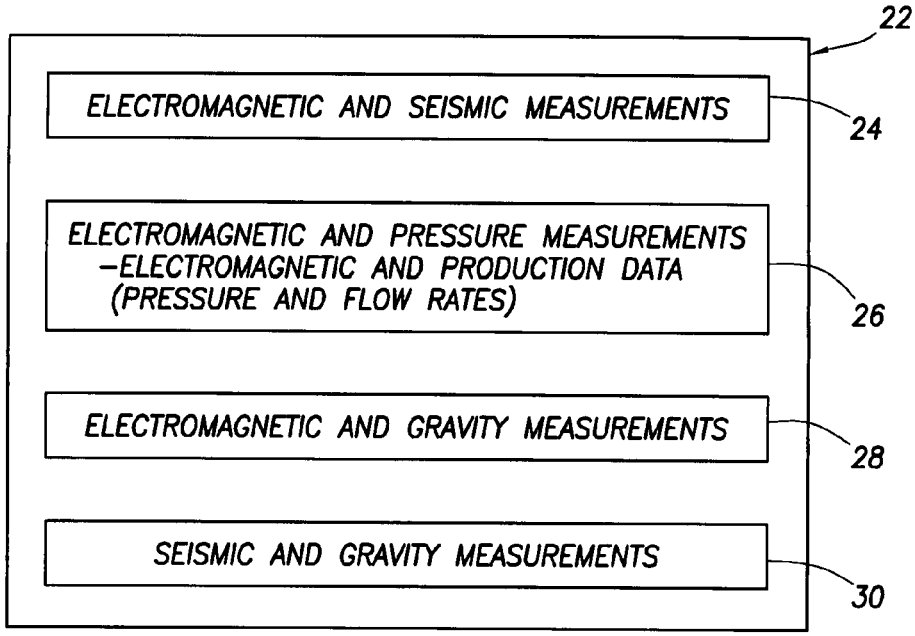
FIG. 5 illustrates a more detailed description of the combination of seismic, electromagnetic, gravity, and pressure measurements of FIG. 4 as including electromagnetic and seismic measurements, electromagnetic and pressure measurements, electromagnetic and gravity measurements, and seismic and gravity measurements.

Referring to FIG. 5, one example of the 'combination of seismic measurements, electromagnetic measurements, gravity measurements, and pressure measurements' 22 of FIG. 4 is illustrated in greater detail. In FIG. 5, one example of the 'integrated combination' of seismic measurements, electromagnetic measurements, gravity measurements, and pressure measurements' 22 of FIG. 4 includes the following combination of measurements: (1) Electromagnetic and Seismic measurements 24, (2) Electromagnetic and Pressure measurements (i.e., Electromagnetic and Production Data (such as pressure and flow rates) 26, (3) Electromagnetic and Gravity measurements 28, and (4) Seismic and Gravity measurements 30. However, as noted earlier, the 'combination of seismic measurements, electromagnetic measurements, gravity measurements, and pressure measurements' 22 of FIG. 4 also includes integrated combinations of the individual measurements (i.e., seismic, electromagnetic, gravity, and pressure) as well as all the possible combinations of these four measurements (i.e., two and three at a time and also all four) in a joint interpretation/inversion.

Referring to FIGS. 6*a* through 12, from an interpretation viewpoint, integration of this suite of measurements 20, 22 of FIGS. 4 and 5 can be carried out at various levels: by constraining the inversion at the level of the formation structural information (bedding, faults, fractures, initial fluid contacts, etc.) or at the level of a more fundamental petrophysical description of the reservoir in terms of its static and dynamic properties (mineralogy, porosity, rock permeability, fluid PVT properties, capillary pressure, relative permeability, fluid saturations, fluid contacts, etc.), or a hybrid approach that combines a mix of the above sets of reservoir attributes. Irrespective of what approach one may adopt, the desirable list of answer products could be producibility, estimates of hydrocarbon volumes in place, and/or any other parameters that are needed to characterize a reservoir and are relevant to geologists/geophysicists, petrophysicists and reservoir engineers for the purpose of managing the reservoir. The benefits of such an approach is to generate a unified reservoir management model that honors diverse sources of information in a coherent and consistent manner and to provide answers that constitute direct inputs to reservoir management.

Measurement synergies will be determined by a particular application and the associated workflow required in delivering the needed answer products for such an application. These synergies can be grouped by two possible scenarios for an integrated interpretation:

1. Given a set of measurements, determine the reservoir parameters that have the most sensitive response to these measurements and only estimate these parameters.
2. For a desired reservoir parameter(s) to be estimated, perform the measurements that are most sensitive to these parameters and only integrate these measurements.

A partial list of applications for such a quad-combo 20 of FIG. 4 is in:

- Hydrocarbon detection:
  - Identifying geological targets containing undrained hydrocarbons prior to and during drilling,
  - Locating bypassed hydrocarbons in brown fields,
  - Geosteering & well placement.
- Reservoir fluid monitoring:
  - Enhanced recovery applications,
  - Monitoring production and fluid movement in conjunction with fluid injection programs (efficiency of sweep) particularly:
    - if used in a time-lapse mode,
    - when constrained using a priori information (e.g., knowledge of the amount of water injected)
  - Detecting and monitoring water and gas coning,
  - Identifying fluid contacts—geosteering.
- Reservoir characterization:
  - Structural geology: input to 3D geological models,
  - Reservoir compartmentalization,
  - Fracture distribution,
  - Fluid contacts,
  - Upscaling: near-wellbore to reservoir scale,
  - History matching/reservoir simulation,
  - Geomechanics,
  - Reservoir property distribution, e.g.:
    - Porosity partitioning in inter-well,
    - Porosity deep in the formation,
    - Relative permeability,
    - Capillary pressure.
- Reservoir management:
  - Improved completion design,
  - Well planning,
  - Intervention and target infill drilling.
- Other monitoring applications:
  - Stimulation monitoring,
  - Frac monitoring,
  - CO2 sequestration and seepage monitoring,
  - Gas production monitoring,
  - Gas storage monitoring.

In the following sections of this specification, we highlight the benefits of the various synergies. The following 'integrated combinations' of the individual measurements (i.e., seismic, electromagnetic, gravity, and pressure) are set forth in the following sections of this specification: (1) Electromagnetic and Seismic measurements, (2) Electromagnetic and Pressure measurements, (3) Electromagnetic and Gravity measurements, and (4) Seismic and Gravity measurements.

Electromagnetic (EM) and Seismic Measurements 24 of FIG. 5

The combination of EM and seismic data could have a variety of benefits for improved reservoir characterization. Seismic provides structural information and EM identifies hydrocarbon versus brine. Additionally, each method is sensitive to the rock porosity; the combination will better define it. The fluid saturation distribution in 3-phase reservoir environment will also be greatly improved mainly by using the EM-based resistivity distribution to segregate insulating (gas and oil) fluid phases from conducting (water) phases. The combination will also allow for a better description of the field geology as EM is better able to define the distribution of low resistivity structures, an example being sub-salt or sub-basalt reservoir structure, where seismic exhibits rapid variation in velocity and attenuation causing imaging problems of the target beneath. There is also the potential for better image resolution; for example EM may be able to provide an updated seismic velocity model (through property correlations) that can lead to an improved depth migration. Finally, EM/seismic combination allows for the reduction of exploration risks, particularly in deep-water environments, prospect ranking and detecting stratigraphic traps.

The methods for this integration could be sequential: for example using the seismic as a template for the initial model, allowing the EM data to adjust this model to fit observations and using petrophysics obtained from logs and core to obtain reservoir parameter distributions from the data. An alternative approach could be alternating between the EM and seismic inversions (starting with seismic) where the inversion result of one is used to constraint the other. In such an approach, any artifacts that are introduced by one inversion will eventually be reduced as we alternate the inversion between EM and seismic since ultimately we will reconstruct a model that is consistent with both EM and seismic data. A third alternative approach is the full joint inversion (simultaneous inversion) of EM and seismic.

Figure 6A:
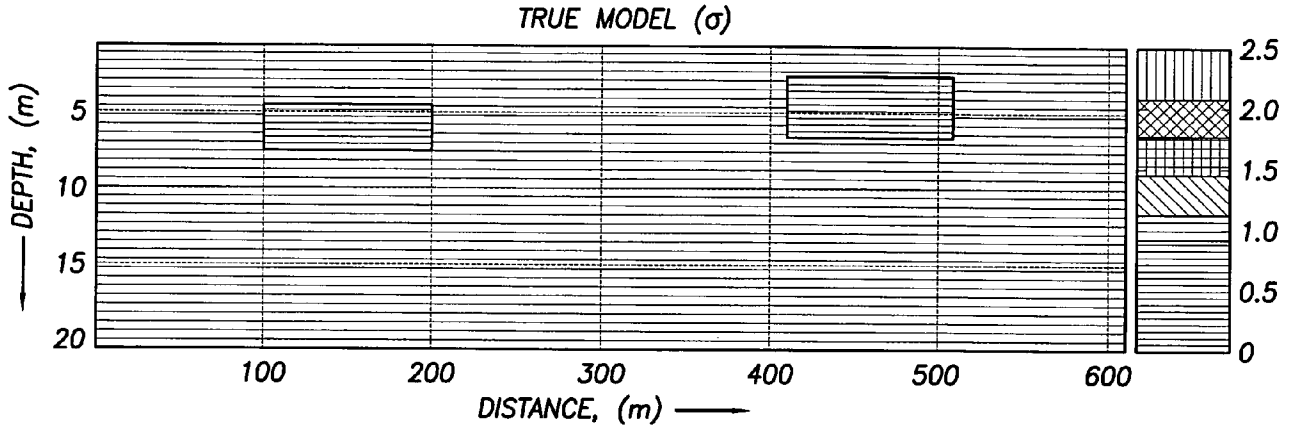
FIGS. 6*a*-6*b* illustrate a true model of conductivity and velocity.
Figure 6B:
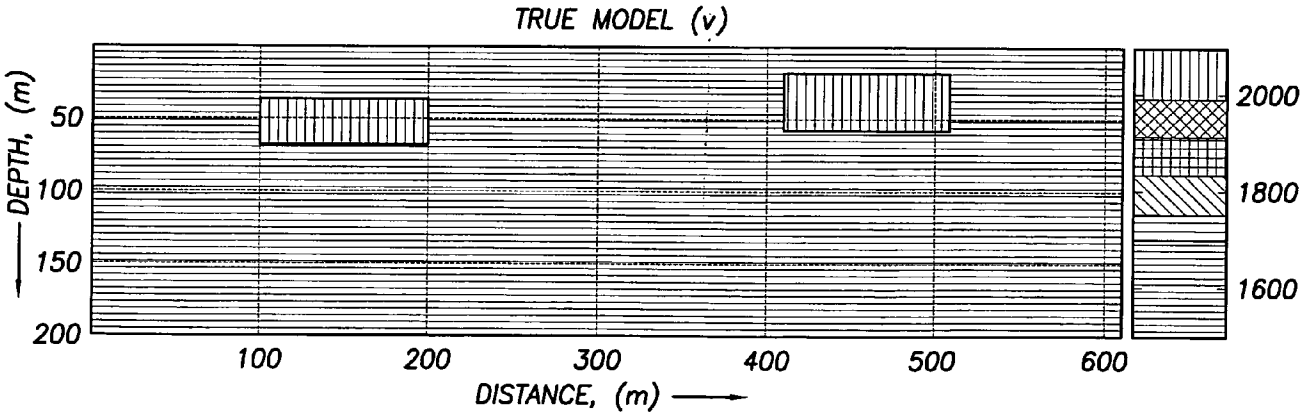

Refer now to FIGS. 6*a*-6*b* which illustrate a true model of conductivity and velocity.

Figure 7A:
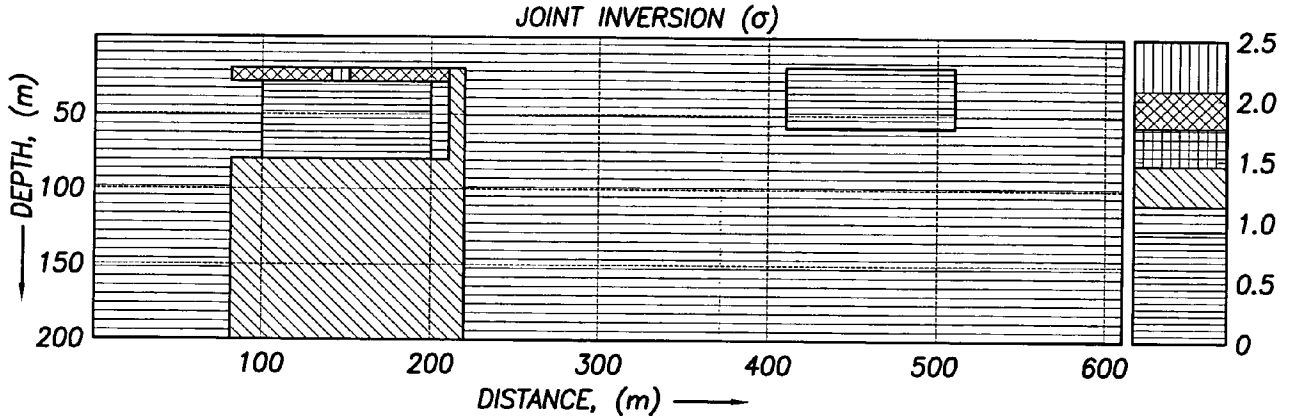
FIGS. 7*a*-7*b* illustrate a reconstructed conductivity and velocity from the joint inversion of electromagnetic (EM) and seismic.
Figure 7B:
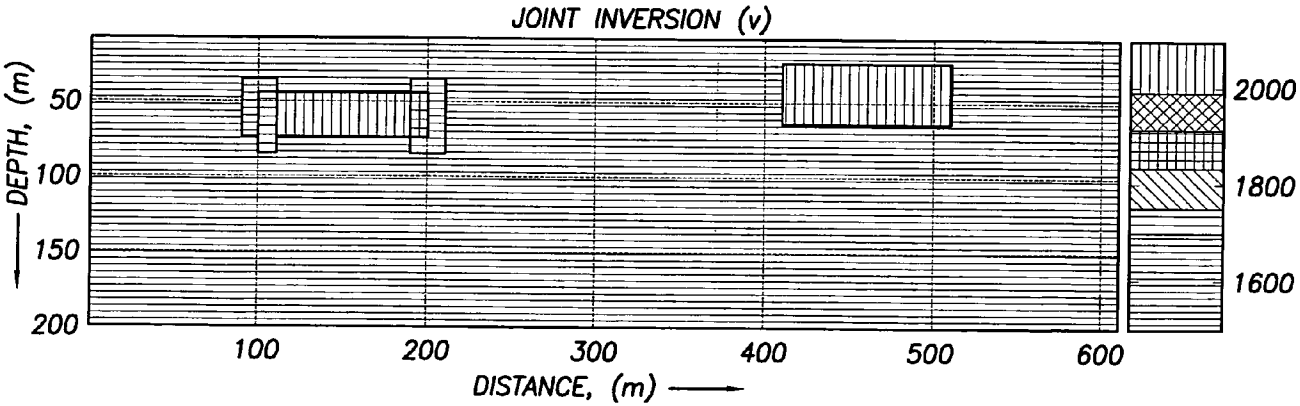

Refer also to FIGS. 7*a*-7*b* which illustrate a reconstructed conductivity and velocity from the joint inversion of Electromagnetic (EM) and seismic.

Electromagnetic and Production Data (Pressure and Flow Rates) 26 of FIG. 5

Electromagnetic (EM) measurements are most sensitive to the water content in the rock pores. Moreover, the formation's petrophysical parameters can have a strong imprint on the spatial distribution of fluid saturations and consequently on EM measurements.

EM measurements can also be quite effective in tracking waterfronts (because of the relatively high contrast in electrical conductivities) particularly if they are used in a time-lapse mode and/or when constrained using a priori information (e.g., knowledge of the amount of water injected). In such applications, cross-well, long-offset single-well, surface and surface-to-borehole EM measurements can benefit from constraining the inversion using a fluid flow model. This can be done by linking the EM simulator to a fluid flow simulator (e.g., GREAT/Intersect, Eclipse) and using the combined simulator as a driver for an iterative inversion.

On the other hand, integrating time-lapse EM measurements acquired in cross-well, single-well, surface or surface-to-borehole modes with flow-related measurements such as pressure and flow-rate measurements from MDT or well testing can significantly improve the robustness of mapping water saturation and tracking fluid fronts. The intrinsic value of each piece of data considerably improves when used in a cooperative, integrated fashion, and under a common petrophysical model.

Physics of multi-phase fluid-flow and EM induction/conduction phenomena in porous media can be coupled by means of an appropriate saturation equation. Thus, a dual-physics stencil for the quantitative joint interpretation of EM and flow-related measurements (pressure and flow rates) can be formulated to yield a rigorous estimation of the underlying petrophysical model. The inverse problem associated with dual-physics consists of the estimation of a petrophysical model described by spatial distribution of porosities and both vertical and horizontal absolute permeabilities.

Figure 8:
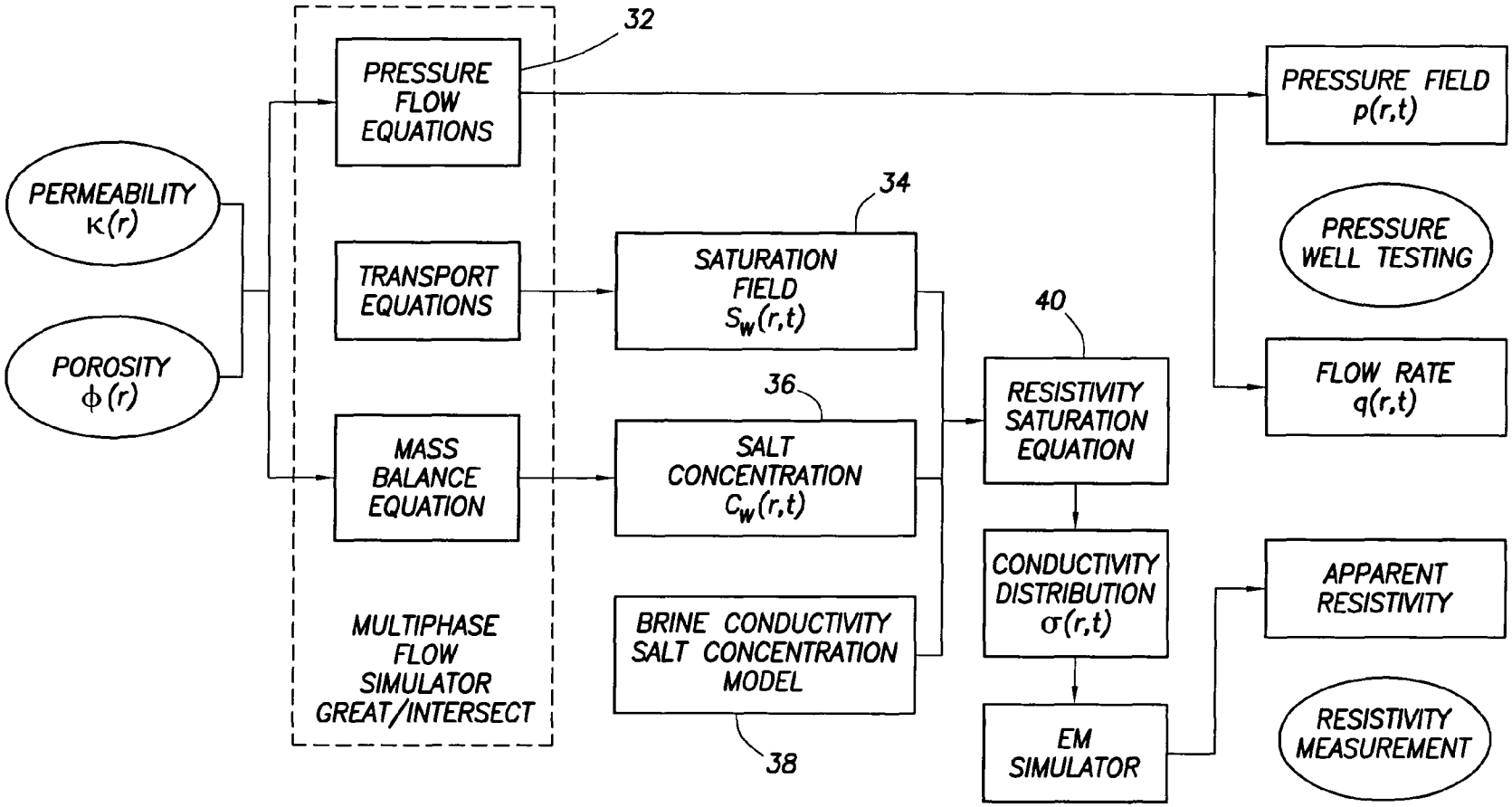
FIG. 8 illustrates a possible workflow for the integration of electromagnetic and production data (pressure and flow rates), FIG. 8 illustrating the method and apparatus by which electromagnetic and production data are integrated together to form a deep reading quad combo suite of measurements.

Refer now to FIG. 8 which illustrates a possible workflow for the integration of electromagnetic and production data (pressure and flow rates), FIG. 8 illustrating the method and apparatus by which electromagnetic and production data are integrated together to form a deep reading quad combo suite of measurements.

In FIG. 8, Pressure 32, saturation 34, and salt concentration 36 fields generated during water injection or production and a subsequent well testing or a wireline formation test can be modeled as multi-phase convective transport of multiple components. Isothermal salt mixing phenomenon taking place within the aqueous-phase due to the invading and in-situ salt concentration can also be taken into account in the context of an EM measurement by means of a brine conductivity model 38. 'Coupling or integrating multi-phase flow and EM physics' is accomplished via Archie's saturation equation 40 or similar saturation equations 40. The result of the aforementioned 'coupling or integrating multi-phase flow and EM physics' will yield a pressure, water saturation, and conductivity spatial maps as a function of time and space.

Figure 9:
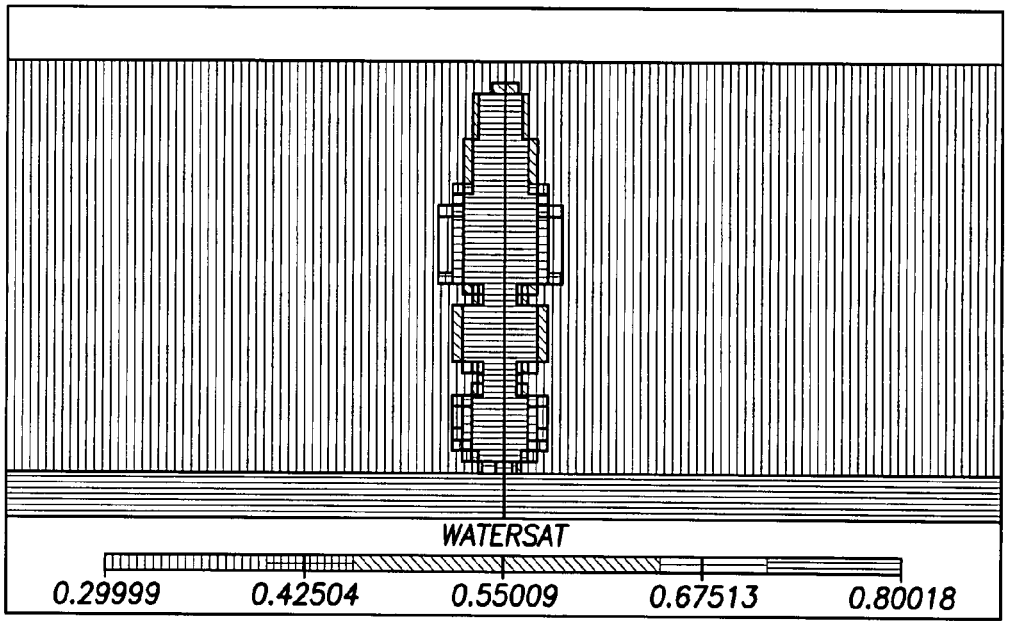
FIG. 9 illustrates a time snapshot of a water saturation spatial distribution.

Refer to FIG. 9 illustrating a time snapshot of the water saturation spatial distribution.

Figure 10:
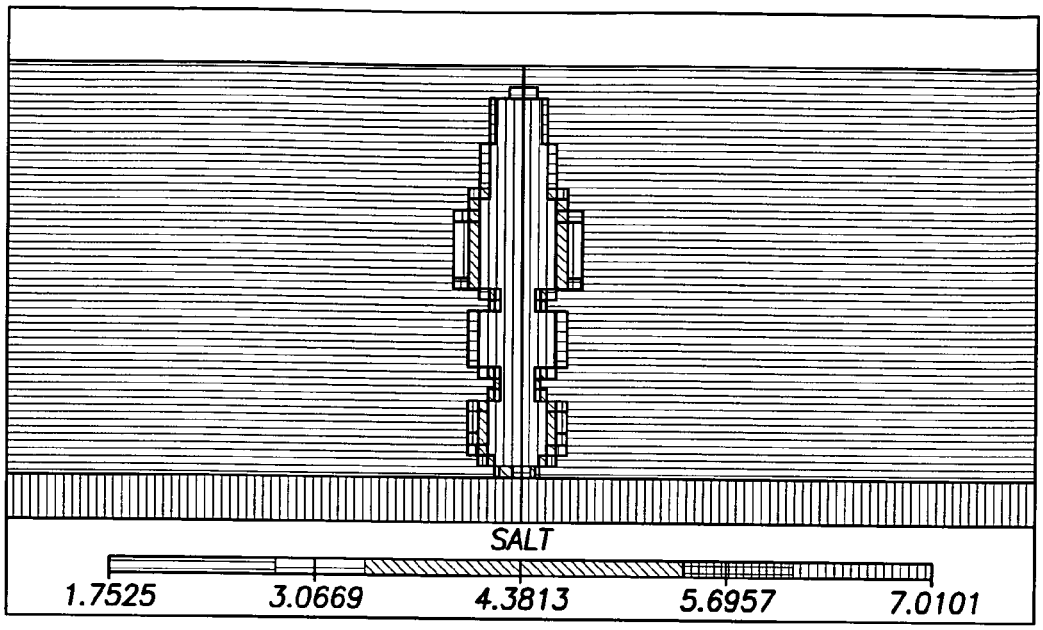
FIG. 10 illustrates a time snapshot of a salt concentration spatial distribution.

Refer to FIG. 10 illustrating a time snapshot of the salt concentration spatial distribution.

Figure 11:
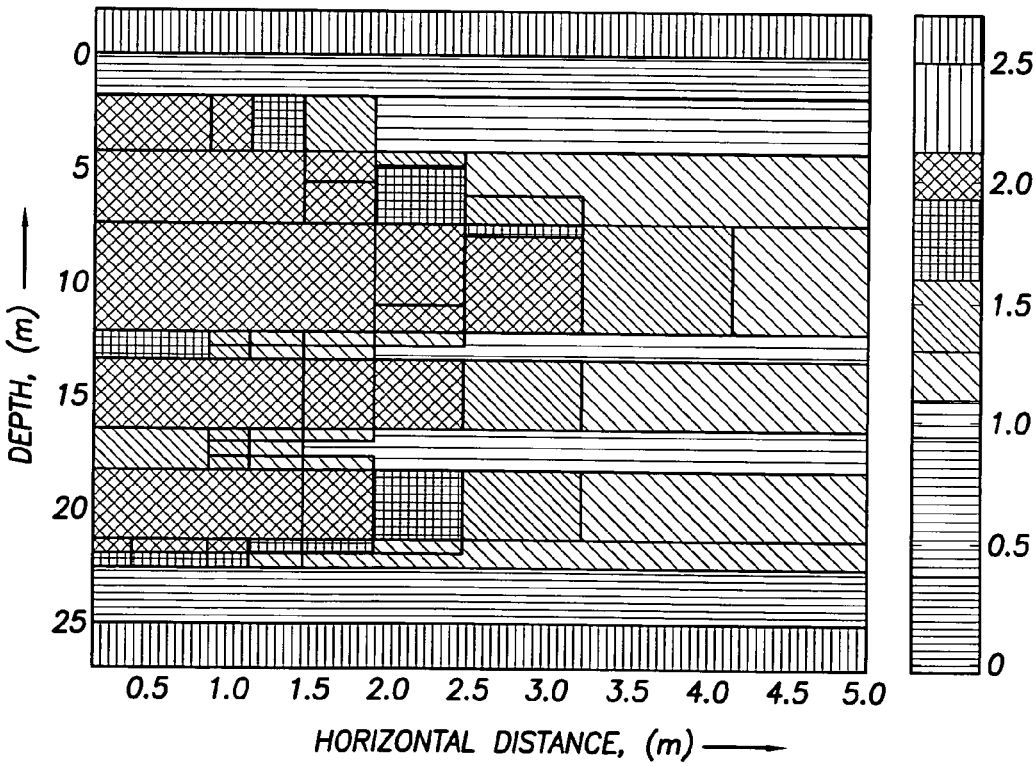
FIG. 11 illustrates a time snapshot of a spatial distribution of the formation conductivity.

Refer to FIG. 11 illustrating a time snapshot of the spatial distribution of the formation conductivity.

Figure 12:
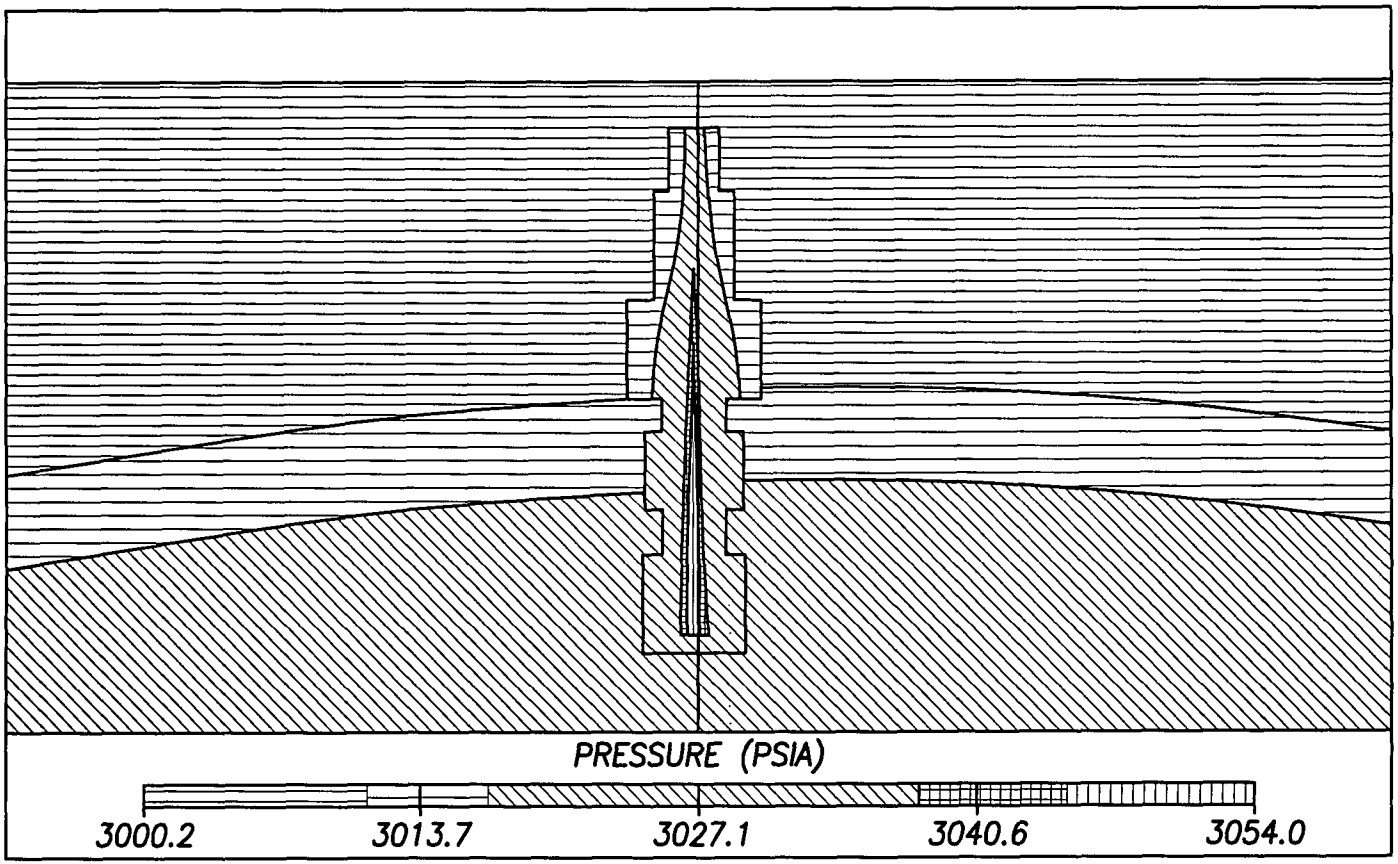
FIG. 12 illustrates a time snapshot of the spatial distribution of formation pressure.

Refer to FIG. 12 illustrating a time snapshot of the spatial distribution of formation pressure.

Role of the Gravity Measurement: Electromagnetic and Gravity Measurements 28 of FIG. 5, and Seismic and Gravity Measurements 30 of FIG. 5

Among the four measurements constituting the quad-combo 20, 22, 28, 30 of FIGS. 4 and 5, gravity is the measurement that is most sensitive to the presence of gas because of the high contrast in density between gas and other fluids or the matrix rock.

Hence, the major application for a borehole gravity measurement is in monitoring gas/liquid contacts (gas/oil and gas/water contacts) and in detecting gas coning—particularly in a time-lapse mode. Secondary applications are monitoring oil/water contacts, imaging salt domes and reefs, measuring the average porosity of vuggy carbonates and in monitoring gas and water floods. As such, gravity measurements can be an excellent compliment to both EM and seismic measurements.

Moreover, the most basic formation evaluation suite of measurements for volumetric analysis relies on a good estimate of the formation density. A gravity measurement (either from the surface or downhole) can provide a reliable and deep probing estimate of the formation density.

Possible synergies between the four measurements of the quad-combo could be:

- Combining EM and gravity can provide a good estimate of changes in water saturation from EM and in gas saturation from gravity measurements
- Both seismic and gravity measurements are sensitive to density, hence by combining density derived from gravity and seismic velocity one can estimate average rock compressibility.
- EM is sensitive to water/oil contacts whereas gravity (as well as seismic) is sensitive to gas/oil contacts. Hence by integrating these measurements one can accurately map the various fluid contacts.

Figure 13:
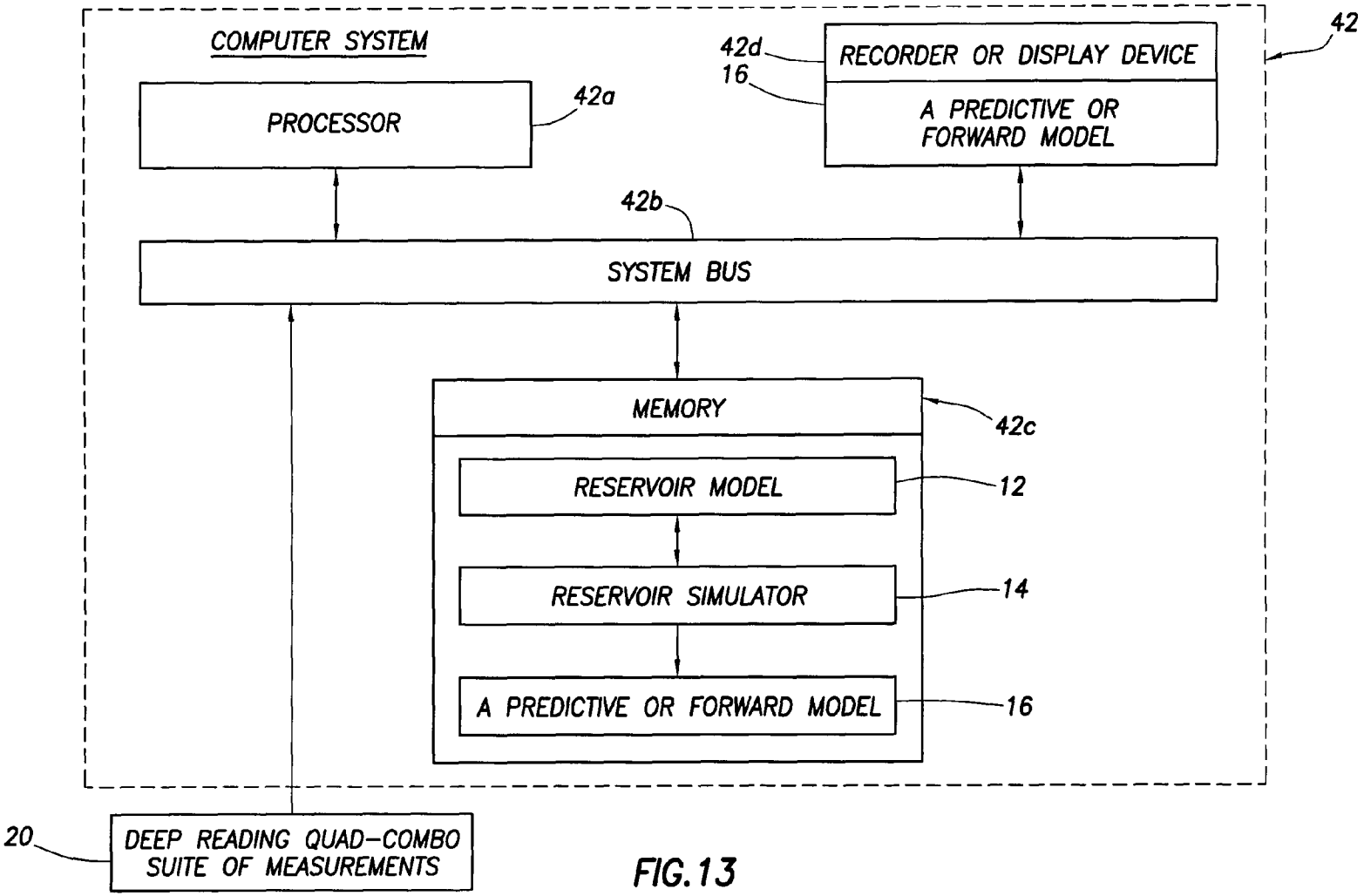
FIG. 13 illustrates a computer system which stores the reservoir model and the reservoir simulator and the predictive or forward model of FIG. 1 and which receives the deep reading quad-combo suite of measurements as illustrated in FIGS. 4 and 5.

Referring to FIG. 13, a workstation or other computer system 42 is illustrated. The computer system 42 of FIG. 13 is adapted for storing the reservoir model and the reservoir simulator and the predictive or forward model of FIG. 1 and it receives the deep reading quad-combo suite of measurements 20, 22 as illustrated in FIGS. 4 and 5.

In FIG. 13, the workstation, personal computer, or other computer system 42 is illustrated adapted for storing the reservoir model 12 and the reservoir simulator 14 and the predictive or forward model 16 of FIG. 1 and it receives the deep reading quad-combo suite of measurements 20, 22 as illustrated in FIGS. 4 and 5. The computer system 42 of FIG. 13 includes a Processor 42*a* operatively connected to a system bus 42*b*, a memory or other program storage device 42*c* operatively connected to the system bus 42*b*, and a recorder or display device 42*d* operatively connected to the system bus 42*b*. The memory or other program storage device 42*c* stores the reservoir model 12 and the reservoir simulator 14 and the predictive or forward model 16 of FIG. 1 and it receives the deep reading quad-combo suite of measurements 20, 22 as illustrated in FIGS. 4 and 5 as disclosed in this specification. The reservoir model 12 and the reservoir simulator 14 which are stored in the memory 42*c* of FIG. 13, can be initially stored on a Hard Disk or CD-Rom, where the Hard Disk or CD-Rom is also a 'program storage device'. The CD-Rom can be inserted into the computer system 42, and the reservoir model 12 and the reservoir simulator 14 can be loaded from the CD-Rom and into the memory/program storage device 42*c* of the computer system 42 of FIG. 13. In FIG. 13, the computer system 42 receives 'input data' 20 including the deep-reading quad-combo suite of measurements 20, 22 as discussed previously in this specification. In operation, the Processor 42*a* will build a reservoir model and its associated parameters 12 in response to the deep-reading quad-combo suite of measurements 20 that is input to the computer system 42. The reservoir model 12 will be the input to a reservoir simulator 14. The processor 42*a* will then cause the reservoir simulator 14 to build the predictive or forward model 16 in response to the reservoir model 12. The Processor 42*a* will then generate an 'output display' that can be recorded or displayed on the Recorder or Display device 42*d* of FIG. 13. The 'output display', which is recorded or displayed on the Recorder or Display device 42*d* of FIG. 13, can generate and display the predictive or forward model 16. The computer system 42 of FIG. 13 may be a personal computer (PC), a workstation, a microprocessor, or a mainframe. Examples of possible workstations include a Silicon Graphics Indigo 2 workstation or a Sun SPARC workstation or a Sun ULTRA workstation or a Sun BLADE workstation. The memory or program storage device 42*c* (including the above referenced Hard Disk or CD-Rom) is a 'computer readable medium' or a 'program storage device' which is readable by a machine, such as the processor 42*a*. The processor 42*a* may be, for example, a microprocessor, microcontroller, or a mainframe or workstation processor. The memory or program storage device 42*c*, which stores the reservoir model 12 and the reservoir simulator 14 and the predictive or forward model 16, may be, for example, a hard disk, ROM, CD-ROM, DRAM, or other RAM, flash memory, magnetic storage, optical storage, registers, or other volatile and/or non-volatile memory.

A functional description of the operation of the 'method for reservoir characterization and monitoring including deep reading quad combo measurements' as described in this specification is set forth in the following paragraphs with reference to FIGS. 1 through 13 of the drawings.

In this specification, a set of deep reading measurements 10 of FIG. 3, comprising a 'deep reading quad combo' suite of measurements 20 of FIG. 3, are sufficiently deep to be able to probe the reservoir and are self-sufficient to provide the means by which we can build a reservoir model and its associated parameters 12 of FIG. 1. Such a reservoir model 12 will be the input to a reservoir simulator 14 of FIG. 1, which, in principle, will provide a mechanism for building the predictive or forward model 16 of FIG. 1. Recall that Reservoir simulators 14 take as input a 'set of parameters', which if known exactly would allow the simulations to deterministically predict the future evolution of the reservoir (with an associated uncertainty error). However, it is generally assumed that the fact that the 'set of input parameters' are poorly known is the dominant uncertainty in the modeling process. Hence a judicial selection of measurements needs to have an impact on the accuracy of these input parameters. As a result, a 'suite of measurements' disclosed in this specification (which we refer to as the "deep-reading quad-combo" suite of measurements 20 of FIG. 4) include 'integrated' combinations of: (1) seismic, (2) electromagnetic, (3) gravity, and (4) pressure measurements, as noted by numeral 22 of FIGS. 4 and 5, and, in addition, (5) all the possible combinations of these four measurements (that is, two and three of these measurements at a time and also all four of these measurements) in a joint interpretation/inversion. Each of these four deep measurements which comprise the "deep-reading quad-combo" 20 of FIG. 4, individually and on their own, will have problems in delivering useful or sufficiently comprehensive information about the reservoir because of the non-uniqueness and limited spatial resolution that are sometimes associated with their interpretation. However, when the 'four deep measurements' which comprise the "deep-reading quad-combo" 20 of FIG. 4 (i.e., seismic, electromagnetic, gravity, and pressure measurements 22 of FIG. 4) are 'integrated together' (an example of which is shown in FIG. 5), or when all the possible combinations of these 'four deep measurements' (that is, two and three of these measurements at a time and also all four of these measurements) are 'integrated together' in a joint interpretation/inversion, or when all the possible combinations of these 'four deep measurements' (that is, two and three of these measurements at a time and also all four of these measurements) are 'integrated together' with other measurements, such as near-wellbore WL and LWD, the 'four deep measurements' which comprise the "deep-reading quad-combo" 20 of FIG. 4 will provide considerable value and significant differentiation. As a result, when the Reservoir simulators 14 of FIG. 1 receive, as an input, the 'integrated set of deep reading quad combo suite of measurements' (i.e., the 'integrated' combination of seismic measurements, electromagnetic measurements, gravity measurements, and pressure measurements 22 of FIG. 4 and as specifically noted by example by numerals 24, 26, 28, and 30 of FIG. 5), the Reservoir simulators 14 of FIG. 1 will now allow the simulations to deterministically and accurately predict the future evolution of the reservoir, as noted by numeral 18 of FIG. 2.

The computer system of FIG. 13 receives the deep reading quad combo suite of measurements 20 and, responsive thereto, the processor 42*a* will build the reservoir model 12. The reservoir model 12 is input to the reservoir simulator 14. The processor 42*a* will execute the reservoir simulator 14 and, responsive thereto, it will generate the predictive or forward model 16. The predictive or forward model can be recorded or displayed on the recorder or display device 42*d*. As noted earlier, since the 'four deep measurements' which comprise the "deep-reading quad-combo" 20 of FIG. 4 [i.e., the 'integrated' combination of seismic, electromagnetic, gravity, and pressure measurements 22 of FIG. 4—that is, all possible combinations of these 'four deep measurements' (two and three of these measurements at a time and also all four of these measurements)] are 'integrated together', and perhaps since they are 'integrated together' with other measurements, such as near-wellbore WL and LWD, when the processor 42*a* receives, as an input, the 'integrated set of deep reading quad combo suite of measurements' 20, the Reservoir simulators 14 of FIG. 1 will now deterministically and accurately predict the future evolution of the reservoir, as noted by numeral 18 of FIG. 2.

The above description of the 'method for reservoir characterization and monitoring including deep reading quad combo measurements' being thus described, it will be obvious that the same may be varied in many ways. Such variations are not to be regarded as a departure from the spirit and scope of the claimed method, and all such modifications as would be obvious to one skilled in the art are intended to be included within the scope of the following claims.

We claim:

1. A method for building a predictive or forward model adapted for predicting a future evolution of a reservoir, comprising:

receiving seismic measurements, electromagnetic (EM) measurements, gravity measurements, and reservoir pressure measurements;

generating a first result by inverting the seismic measurements, wherein the first result comprises an artifact;

generating a second result by inverting the EM measurements constrained by the first result;

generating a refined result by constraining the first result by the second result to reduce the artifact;

generating, by a fluid flow simulator, a fluid flow model based on the reservoir pressure measurements;

generating a pressure, water saturation, and conductivity spatial maps by constraining an inversion of the EM measurements using the fluid flow model from the fluid flow simulator coupled to an EM simulator by Archie's saturation equation;

obtaining a first density of the reservoir from the gravity measurements;

obtaining a second density of the reservoir from the seismic measurements;

estimating average rock compressibility in the reservoir by combining the first density and the second density;

generating a map of fluid contacts in the reservoir by integrating the EM measurements and the gravity measurements, wherein the EM measurements are sensitive to water/oil contacts, and wherein the gravity measurements are sensitive to gas/oil contacts;

generating, by a processor, a reservoir model and associated parameters based upon the refined result, the pressure, water saturation, conductivity special maps, the average rock compressibility, and the map of fluid contacts; and receiving, by a reservoir simulator, the reservoir model and, responsive thereto, generating the predictive or forward model.

2. The method of claim 1, further comprising:

generating joint inversion combinations of two of the following measurements: the seismic measurements, the EM measurements, the gravity measurements, and the reservoir pressure measurements, wherein generating the reservoir model is further based on the joint inversion combinations.

3. The method of claim 2, wherein said joint inversion combinations of two of the following measurements is selected from a group consisting of: EM and Seismic measurements, EM and Gravity measurements, and Seismic and Gravity measurements.

4. The method of claim 1, further comprising:

generating joint inversion combinations of three of the following measurements: the seismic measurements, the EM measurements, the gravity measurements, and the reservoir pressure measurements, wherein generating the reservoir model is further based on the joint inversion combinations.

5. The method of claim 1, further comprising:

generating a joint inversion combination of all four of the following measurements: the seismic measurements, the EM measurements, the gravity measurements, and the reservoir pressure measurements, wherein generating the reservoir model is further based on the join inversion combination.

6. A system adapted for building a predictive or forward model adapted for predicting a future evolution of a reservoir, comprising:

a processor executing the steps of:

receiving seismic measurements, electromagnetic (EM) measurements, gravity measurements, and reservoir pressure measurements;

generating a first result by inverting the seismic measurements, wherein the first result comprises an artifact;

generating a second result by inverting the EM measurements constrained by the first result;

generating a refined result by constraining the first result by the second result to reduce the artifact;

generating, by a fluid flow simulator, a fluid flow model based on the reservoir pressure measurements;

generating pressure, water saturation, and conductivity spatial maps by constraining an inversion of the EM measurements using the fluid flow model from the fluid flow simulator coupled to an EM simulator by Archie's saturation equation;

generating a map of fluid contacts in the reservoir by integrating the EM measurements and the gravity measurements, wherein the EM measurements are sensitive to water/oil contacts, and wherein the gravity measurements are sensitive to gas/oil contacts; and generating a reservoir model and associated parameters based upon the refined result, the pressure, water saturation, conductivity special maps, the average rock compressibility, and the map of fluid contacts, the processor executing a reservoir simulator, the reservoir simulator receiving the reservoir model and, responsive thereto, generating the predictive or forward model, the predictive or forward model being adapted for predicting the future evolution of said reservoir based on the reservoir model.

7. The system of claim 6, further comprising the processor executing the steps of: generating joint inversion combinations of two of the following measurements: the seismic measurements, the EM measurements, the gravity measurements, and the reservoir pressure measurements.

8. The system of claim 7, wherein said joint inversion combinations of two of the following measurements is selected from a group consisting of: EM and Seismic measurements, EM and Gravity measurements, and Seismic and Gravity measurements.

9. The system of claim 6, further comprising the processor executing the steps of: generating joint inversion combinations of three of the following measurements: the seismic measurements, the EM measurements, the gravity measurements, and the reservoir pressure measurements.

10. The system of claim 6, further comprising the processor executing the steps of: generating a joint inversion combination of all four of the following measurements: the seismic measurements, the EM measurements, the gravity measurements, and the reservoir pressure measurements.

11. A non-transitory computer readable medium comprising instructions for building a predictive or forward model adapted for predicting a future evolution of a reservoir, the instructions when executed by a processor perform the steps of:

receiving seismic measurements, electromagnetic (EM) measurements, gravity measurements, and reservoir pressure measurements;

generating a first result by inverting the seismic measurements, wherein the first result comprises an artifact;

generating a second result by inverting the EM measurements constrained by the first result;

generating a refined result by constraining the first result by the second result to reduce the artifact;

generating, using a fluid flow simulator, a fluid flow model based on the reservoir pressure measurements;

generating pressure, water saturation, and conductivity spatial maps by constraining an inversion of the EM measurements using the fluid flow model from the fluid flow simulator coupled to an EM simulator by Archie's saturation equation;

obtaining a first density of the reservoir from the gravity measurements;

obtaining a second density of the reservoir from the seismic measurements;

estimating average rock compressibility in the reservoir by combining the first density and the second density;

generating a map of fluid contacts in the reservoir by integrating the EM measurements and the gravity measurements, wherein the EM measurements are sensitive to water/oil contacts, and wherein the gravity measurements are sensitive to gas/oil contacts;

generating a reservoir model and associated parameters based upon the refined result, the pressure, water saturation, conductivity special maps, the average rock compressibility, and the map of fluid contacts; and generating, using a reservoir simulator, the predictive or forward model adapted for predicting the future evolution of the reservoir based on the reservoir model.

12. The non-transitory computer readable medium of claim 11, further comprising instructions which when executed by the processor perform the steps of:

generating joint inversion combinations of two of the following measurements: the seismic measurements, the EM measurements, the gravity measurements, and the reservoir pressure measurements, wherein the reservoir model is further based on the joint inversion combinations.

13. The non-transitory computer readable medium of claim 12, wherein said joint inversion combinations of two of the following measurements is selected from a group consisting of: EM and Seismic measurements, EM and Gravity measurements, and Seismic and Gravity measurements.

14. The non-transitory computer readable medium of claim 11, further comprising instructions which when executed by the processor perform the steps of:

generating joint inversion combinations of three of the following measurements: the seismic measurements, the EM measurements, the gravity measurements, and the reservoir pressure measurements.

15. The non-transitory computer readable medium of claim 11, further comprising instructions which when executed by the processor perform the steps of: generating a joint inversion combination of all four of the following measurements: the seismic measurements, the EM measurements, the gravity measurements, and the reservoir pressure measurements.

16. A program storage device readable by a machine tangibly embodying a set of instructions executable by the machine for building a predictive or forward model adapted for predicting a future evolution of a reservoir, the method steps comprising:

receiving, by the machine, seismic measurements, electromagnetic (EM) measurements, gravity measurements, and reservoir pressure measurements;

generating a first result by inverting the seismic measurements, wherein the first result comprises an artifact;

generating a second result by inverting the EM measurements constrained by the first result;

generating a refined result by constraining the first result by the second result to reduce the artifact;

generating, by a fluid flow simulator, a fluid flow model based on the reservoir pressure measurements;

generating pressure, water saturation, and conductivity spatial maps by constraining an inversion of the EM measurements using the fluid flow model from the fluid flow simulator coupled to an EM simulator by Archie's saturation equation;

generating a reservoir model and associated parameters based upon the refined result, the pressure, water saturation, conductivity special maps, the average rock compressibility, and the map of fluid contacts; and generating the predictive or forward model adapted for predicting the future evolution of the reservoir based on the reservoir model.

17. The program storage device of claim 16, the method steps further comprising:

generating joint inversion combinations of two of the following measurements: the seismic measurements, the EM measurements, the gravity measurements, and the reservoir pressure measurements.

18. The program storage device of claim 17, wherein said joint inversion combinations of two of the following measurements is selected from a group consisting of: EM and Seismic measurements, EM and Gravity measurements, and Seismic and Gravity measurements.

19. The program storage device of claim 16, the method steps further comprising:

generating joint inversion combinations of three of the following measurements: the seismic measurements, the EM measurements, the gravity measurements, and the reservoir pressure measurements.

20. The program storage device of claim 16, the method steps further comprising:

generating a joint inversion combination of all four of the following measurements: the seismic measurements, the EM measurements, the gravity measurements, and the reservoir pressure measurements.

* * * * *